United States Patent [19]

Narikiyo

[11] 4,267,541

[45] May 12, 1981

[54] DEFLECTION YOKE APPARATUS WITH CONVERGENCE DEVICE FOR IN-LINE COLOR TELEVISION CATHODE-RAY TUBE

[75] Inventor: Tatsuichi Narikiyo, Yokohama, Japan

[73] Assignee: Denki Onkyo Co., Ltd., Tokyo, Japan

[21] Appl. No.: 969,677

[22] Filed: Dec. 15, 1978

[51] Int. Cl.[3] ..... H01F 3/00

[52] U.S. Cl. ..... 335/212; 335/210

[58] Field of Search ..... 335/210, 212, 213; 358/248, 249

[56] References Cited

U.S. PATENT DOCUMENTS

| | | | |
|---|---|---|---|
| 3,305,807 | 2/1967 | Ashley et al. | 335/210 |
| 3,350,592 | 10/1967 | Mason | 335/210 |
| 3,462,638 | 8/1969 | Tetsuo et al. | 313/428 X |
| 3,469,218 | 9/1969 | Zoladz | 335/210 |
| 4,088,930 | 5/1978 | Barten | 335/213 X |
| 4,096,531 | 6/1978 | Yamada et al. | 358/248 |

*Primary Examiner*—George Harris

*Attorney, Agent, or Firm*—Armstrong, Nikaido, Marmelstein & Kubovcik

[57] ABSTRACT

A deflection yoke apparatus comprising a yoke which is provided with horizontal and vertical deflection coils, a coil separator disposed between these deflection coils and a deflection core which surrounds the above-mentioned parts, and a convergence device which is attached to a rear part of said yoke and provided with a pair of coil devices which converge electron beams and a cover which supports the coil devices, wherein a pair of coil devices are arranged in a vertical direction intersecting at right angles to the direction of the in-line array of electron beam, the coil devices comprise U-shaped cores and convergence coils which are mounted on the U-shaped cores and supply a fixed amount of vertical deflection current and the U-shaped cores are constructed to be movable in the direction of electron beam to converge electron beams though the convergence coils are fixedly positioned.

5 Claims, 6 Drawing Figures

DEFLECTION YOKE APPARATUS WITH CONVERGENCE DEVICE FOR IN-LINE COLOR TELEVISION CATHODE-RAY TUBE

BACKGROUND OF THE INVENTION

The present invention relates to an electromagnetic deflection yoke apparatus for cathode-ray tubes, specifically a deflection yoke apparatus suited to in-line beam type color television cathode-ray tubes which is adapted to improve color distortion of a picture including rasters individually formed by three electron beams on a faceplate of the cathode-ray tube, particularly a narrow raster formed by a center electron beam, through a pair of U-shaped cores provided to be movable in a direction intersecting at right angles to the direction of an array of electron guns.

Recently, a conversionless type deflection yoke capable of adjusting dynamic convergence without employing an independent dynamic convergence system has been developed as a deflection yoke for an in-line color television cathode-ray tube. This deflection yoke is intended to adjust dynamic convergence by varying the distribution of windings of horizontal and vertical deflection coils or shifting and/or inclining the deflection yoke in all directions of three-dimensional coordinates expressed by X, Y and Z axes, thereby consequently varying the relative position of deflection flux which acts on electron beams.

In such a deflection yoke, the horizontal deflection coil is adapted to generate a pin cushion type deflection field and the vertical deflection coil to generate a barrel type deflection field. Under the effect of the above-mentioned deflection field, of three primary color electron beams emitted from three electron guns, that is blue, green and red electron guns disposed in in-line arrangement in the horizontal direction, the intensity of deflection field for the green electron beam emitted from the electron gun located at the center is smaller in the vertical deflection direction than the intensity of deflection fields for blue and red electron beams emitted from the electron guns located at both sides of the green electron gun. As a result, as shown in FIG. 1, three color electron beams deviate from one another at corners of the picture appearing on the faceplate of the cathode-ray tube; particularly, raster G formed by green beam 12 at the top and the bottom of the picture largely deviates inside from raster R and B formed by blue beam 10 and red beam 14.

Therefore when the above-mentioned type deflection yoke is to be used, magnetic devices are provided near the beam emission outlet of the electron gun on the neck of the cathode-ray tube, separately from the deflection yoke and a part of the deflection field generated from the horizontal and vertical deflection coils is separately introduced into the magnetic devices and this partial field is forced to mainly affect green beam 12 which is located at the center to supplementarily deflect in advance this green beam, thus improving narrow raster and misconvergence due to the green beam.

However, in such a system, a preliminary deflection field which affects beam 12 at the center is fixedly determined by the intensity of deflection field of both deflection coils and/or the shape or position of the magnetic device and therefore a desired adjustment cannot be carried out. When the deflection yoke is shifted, for example, in the axial direction of the cathode-ray tube, the magnetic device does not move following up the deflection yoke and accordingly the relative position of magnetic flux which acts on green beam 12 varies along with shifting of the deflection yoke whereby an optimum preliminary deflection field cannot be obtained at all times. Moreover, since the magnetic device is provided near the electron guns, for example, a focus will be adversely affected.

Accordingly, an object of the present invention is provide a deflection yoke apparatus for the in-line color television cathode-ray tube which does not cause color deviation of the raster due to the beam at the center of the faceplate.

Another object of the present invention is to provide a convergenceless type deflection yoke apparatus for the in-line television cathode-ray tube which does not cause a coma at the top and bottom of the picture.

Another object of the present invention is to provide a convergenceless type deflection yoke apparatus capable of improving a narrow raster and obtaining a satisfactory convergence at all positions on the picture without any deflection distortion of the focus and others.

Another object of the present invention is to provide an electromagnetic deflection yoke apparatus capable of free adjustment of the convergence of a narrow raster regardless of the positional state of the deflection yoke apparatus mounted on the cathode-ray tube.

SUMMARY OF THE INVENTION

A preferable embodiment of the present invention is a deflection yoke apparatus comprising a yoke which generates the deflection field and a convergence device which is mounted integral with the rear part of the yoke for a color television cathode-ray tube which is not internally or externally provide with a magnetic device for preliminarily deflecting electron beams in the in-line arrangement in its neck. The yoke is provided with horizontal deflection coils which generate a pin-cushion type horizontal deflection field, vertical deflection coils which generate a barrel type deflection field, a coil separator positioned between these coils and a deflection core arranged to surround both coils and the coil separator. The convergence device has a pair of convergence coil devices for proper convergence of three electron beams on all points of the faceplate and a cover for supporting the convergence coil devices and fixing them to the yoke. A pair of convergence coil devices are arranged above and below the neck of the cathode-ray tube in the direction intersecting at right angles to the in-line arrangement of three electron beams. The convergence coil device has a U-shaped magnetic core and a convergence coil which is mounted on said core and admits a fixed amount of vertical deflection current. This coil is secured on the cover while the core is adapted to be movable in the direction of electron beams to reduce color distortion and converge the electron beams onto proper positions on the faceplate with its U-shaped end directed toward the electron beams.

DETAILED DESCRIPTION OF THE INVENTION

The deflection yoke apparatus in accordance with the present invention is employed in the in-line color television picture tube in which the magnetic device which introduces part of the deflection field generated from the horizontal deflection coil and/or the vertical deflection coil to make it act on a specific electron beam or all electron beams and supplementarily deflects the electron beams is not provided on and/or in the picture tube neck near the beam emission outlets of the electron guns.

Figure 1:
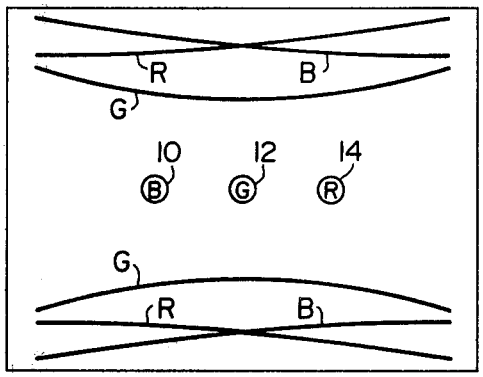
FIG. 1 is a raster showing color deviation due to the deflection yoke which has no convergence coil device on the faceplate of the in-line color television picture tube.
Figure 2:
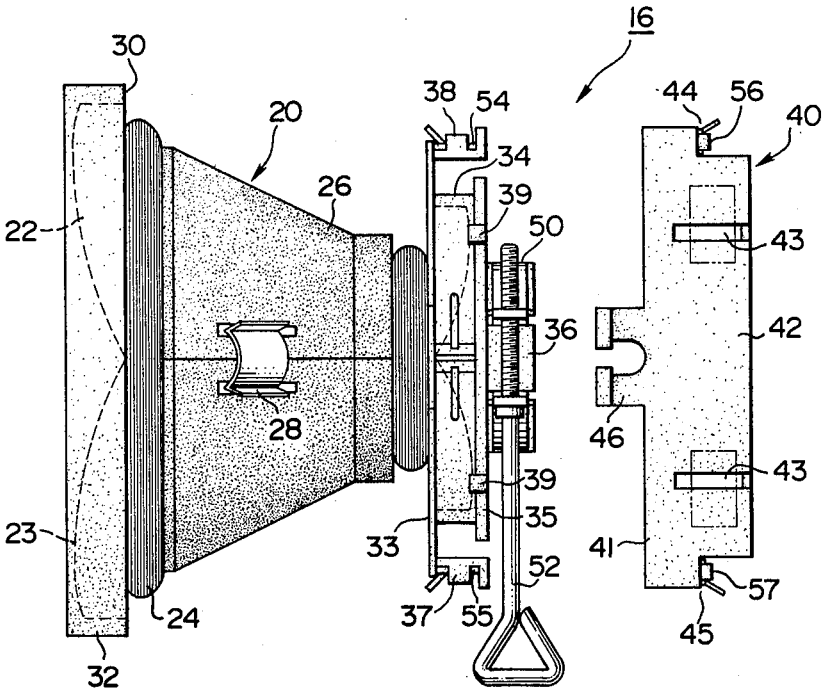
FIG. 2 is an embodiment of the deflection yoke apparatus to be employed in the in-line color television picture tube, the yoke and the convergence device being separately shown.

FIG. 2 shows an embodiment of the present invention used in the above-mentioned in-line color television picture tube. The deflection yoke apparatus 16 comprises the yoke 20 provided with the deflection coil and the convergence device 40. The yoke 20 comprises a flared coil separator 30, a pair of saddle type horizontal deflection coils 22 and 23 arranged inside the coil separator, a pair of saddle type vertical deflection coils 24 and 25 arranged outside the coil separator and a deflection core consisting of a ferrite which surrounds the vertical deflection coil.

The horizontal deflection coils 22 and 23 are formed in a shape of coil so that a pin-cushion type field is formed at the screen side, that is, at the front part and a barrel type field is formed at the electron gun side, that is, at the rear part, thus forming a pin-cushion type deflection field as a whole, whereas the vertical deflection coils 24 and 25 are formed in a shape of coil so that a barrel type field is formed at the front part and a pin-cushion type field is formed at the rear part, thus forming a barrel type deflection field as a whole.

Figure 3:
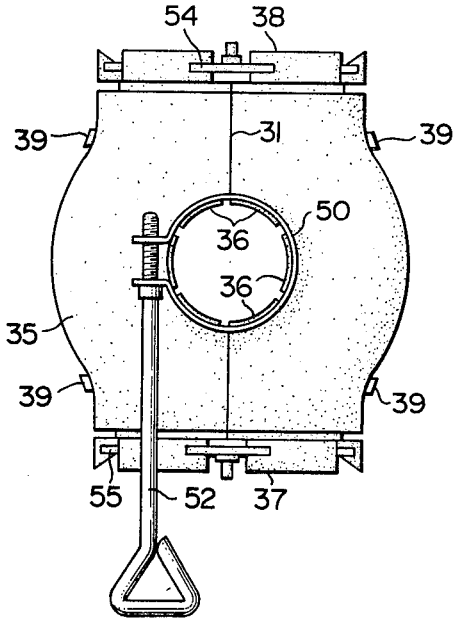
FIG. 3 is a view of the yoke shown in FIG. 2 as seen from the electron gun side.

The core 26 is divided into two halves and these two parts are coupled firmly at its joint part by a set of rigid clips 28. The coil separator 30 is made to be splittable at its joint part 31, and the front part is provided with the front flange 32 and the rear part with an expanded chamber 34 which houses the rear across-jointing wires of the horizontal deflection coils 22 and 23. A plurality of segments 36 which are extended rearwardly along the neck of the cathode-ray tube are provided around the hole on the rear wall 35 of the expanded chamber 34 through which the neck of the cathode-ray tube is inserted, as shown in FIG. 3. The clamp band 50 made of a non-magnetic material such as, for example, bronze phosphide and stainless steel is applied outside the segments and the deflection yoke can be fixed on the neck of the cathode-ray tube by tightening the clamp bolt 52 made of the same non-magnetic material as for the clamp band 50. The rear expanded wall 35 is provided with four projections 39 which are projected in a lateral direction.

The front expanded wall 33 of the expanded chamber 34 of the coil separator 30 is extended upward and downward and provided with the terminal parts 37 and 38, and the terminal plates 54 and 55 on which a plurality of terminals are fixed are attached to these terminal parts and the lead wires from the deflection coils are connected to these terminals.

The convergence device 40 has the cover 42 to be mounted on the expanded chamber 34 of the coil separator 30 and is provided with the coil devices at a position shown by a broken line inside the cover 30. On the side wall 41 of the cover 42, four slits 43 corresponding to the projections 39 of the expanded chamber 34 are formed and the convergence device 40 is fixed on the yoke 16 by engaging the projections 39 with the slits 43. The terminal parts 44 and 45 are formed on the upper and lower parts of the cover 42 and provided with the terminal plates 56 and 57 on which a plurality of terminals to which the lead wires from the coil device are connected are fixed. The projected member 46 having a U-shaped slot is formed to project from the edge of the side wall 41 of the cover 42 to collectively secure the lead wires which connect the terminals of terminal plates 54, 55, 56 and 57 to the external deflection circuit.

Figure 4:
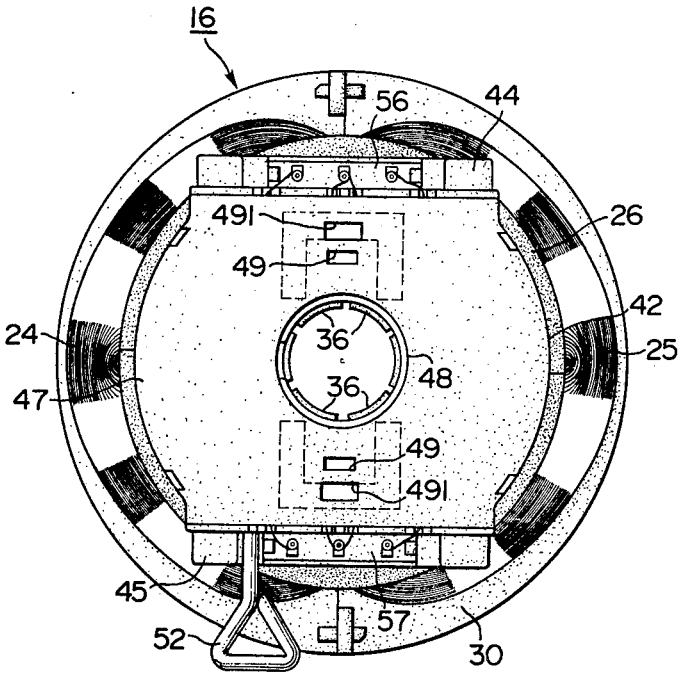
FIG. 4 is a view of the deflection yoke apparatus in accordance with the present invention as viewed from the electron gun side.

FIG. 4 shows the deflection yoke 16 as viewed from its rear side and the plain wall 47 of the cover 42 is provided with an opening 48 with a larger diameter than that of an opening formed by clamp segments 36 of the coil separator 30 and adjusting holes 49 and 491 for adjustment of the convergence are provided at the positions on the coil device shown with a dotted line.

Figure 5:
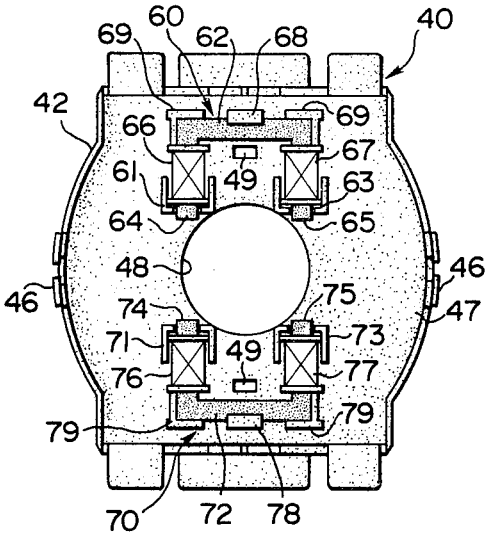
FIG. 5 is a view of the convergence device to be built in the deflection yoke apparatus in accordance with the present invention as seen from the screen side.

FIG. 5 shows the convergence device as viewed from its inside. A pair of convergence coil devices 60 and 70 are arranged to oppose each other with the opening 48 interpositioned therebetween on the inside wall of the cover 40. The coil devices 60 and 70 comprise U-shaped magnetic cores 62 and 72 made of ferrite and the convergence coils 66, 67, 76 and 77 which are inserted into both legs 64, 65, 74 and 75 of the cores. These coils are wound on a coil bobbin made by molding a plastic material and the holes of the coil bobbin into which the core legs are inserted are as large as to permit free connection of the coils to the cores.

A pair of L-shaped upright members 69 and 79 which support the shoulders of the cores 62 and 72 from both their sides and pairs of L-shaped upright members 61, 63, 71 and 73 which support both legs 64, 65, 74 and 75 of the cores from their both sides are formed at the positions corresponding to cores 62 and 72 on the internal surface of the cover, and moreover the depressing tongues 68 and 78 with resilience to depress the cores 62 and 72 towards the opening 48 are provided.

The coils 66, 67, 76 and 77 inserted into the core legs 64, 65, 74 and 75 are fixedly supported by the upright members 69, 61, 63, 79, 71 and 73 while the cores 62 and 72 are fully pushed down by the resilience of the depressing tongues 68 and 78 in a direction intersecting at right angles to the direction of opening 48, in other words, the direction of the array of three color electron beams, 10, 12 and 14. The extreme ends of core legs 64, 65, 74 and 75 are located at the edge of opening 48 to oppose to the neck of the cathode-ray tube through the clamp segment 36 of the coil separator 30.

Convergence coils 66 and 67 and convergence coils 76 and 77 are connected in parallel so that the magnetic fluxes which are generated from these convergence coils and pass through the cores 62 and 72 flow in the same direction. Moreover these convergence coils 66 and 67 are connected in series to convergence coils 76 and 77 so that the magnetic fluxes generated from said coils flow in the same direction, in other words, the direction of the array of electron beams without intersecting each other at the opening 48. The convergence coils 66, 67, 76 and 77 are connected in series to a vertical deflection circuit, for example, the vertical deflection coil so that the vertical deflection current flows in the coils.

The following describes the operation. When the convergence device 40 is attached to the yoke 20 as shown in FIG. 4, a pair of convergence coils 60 and 70 are as attached to the rear wall 35 of the expanded chamber 34 of the yoke 20. The deflection yoke apparatus 16 provided with the convergence device 40 is mounted onto the neck of the cathode-ray tube to first adjust the purity and the clamp segment 36 is fixed to the neck by rotating the clamp bolt 52 at that position to reduce the diameter of the clamp band 50. A wedge as disclosed in the U.S. Pat. No. 4,095,260 titled "Color Picture Tube Device" is inserted between the valve of the cathode-ray tube and the deflection coil to adjust inclination of the front part of the deflection yoke apparatus 16 and fix the deflection yoke apparatus 16.

Figure 6:
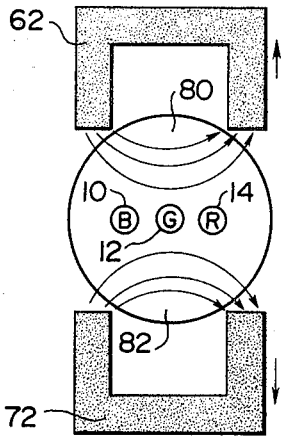
FIG. 6 shows an operation of the convergence device shown in FIG. 5.

After the above-mentioned adjustment, the positions of the cores 62 and 72 in the vertical direction are adjusted by inserting a tool such as a screw driver into the adjusting hole 49 provided in the plain wall 47 of the cover 42. In other words, as briefly illustrated in FIG. 6, the cores 62 and 72 are forced at the nearest positions to the electron beams 10, 12 and 14 by the depressing tongues 68 and 78 and are strongly affected by the magnetic fluxes 80 and 82 to be largely preliminarily deflected. In most cases, the convergence adjustment is excessively done under such a condition and accordingly, the cores 62 and 72 are moved by several millimeters in the arrowhead direction that is, in the radial outward direction to ensure adjustment to the optimum convergence. This adjustment reduces color deviation on the screen of the cathode-ray tube to a permissible range.

Thus the adjustment of convergence is carried out by an incremental shift of the cores 62 and 72 to the direction of electron beams without varying the amount of current flowing in the coils 66, 67, 76 and 77.

After adjustment of the convergence, a bonding agent is applied into the adjusting hole 491 to fix the cores 62 and 72 to the inside of the plain wall 47 of the cover 42.

In the above-mentioned embodiment, a saddle type vertical deflection coil is shown. In case of the present invention, the vertical deflection coil can be made by toroidally winding the wire onto the deflection core 26.

In the above-mentioned embodiment, an example is described in which the projection 39 provided on the rear wall 35 of the expanded chamber 34 is engaged with the slit 43 provided in the side wall 41 of the cover 42 to engage the cover 42 with the expanded chamber 34 of the coil separator 30. If the cover 42 is fixed to the coil separator, it can be constructed as shown in the attached diagram. For example, the cover 42 and the coil separator 30 can be fixed by a threaded means or a bonding agent.

In the above-mentioned embodiment, moreover, the convergence is adjusted by shifting the convergence cores 62 and 72 and, for example, a gear means can be used as a shifting means and the construction can be varied into various types.

A certain kind of supporting means is required to fix the deflection yoke apparatus to the cathode-ray tube. The front part of the deflection yoke can be supported by a deflection yoke holder as disclosed in the U.S. Pat. No. 3,921,110 titled "Deflection Yoke Holding Device" instead of the above-mentioned three wedges. When a deflection yoke holder as disclosed in the U.S. Pat. No. 3,786,185 titled "Cathode-ray Tube-Yoke Platform-Yoke Combination and Method of Assembling the Combination" is used, the clamp segment 36, clamp band 50 and bolt 52 shown in FIG. 2 will be unnecessary.

What is claimed is:

1. A deflection yoke apparatus for color television cathode-ray tubes having three in-line electron beams, said apparatus comprising:

(a) a deflection core;

(b) a pair of horizontal and vertical deflection coils each having conductors extending along the surface of said core for deflecting said three electron beams in the horizontal and vertical directions;

(c) a coil separator means positioned between said deflection coils to electrically insulate said deflection coils;

(d) a pair of movable convergence coil means for converging said three electron beams onto the screen of said cathode-ray tube, each convergence coil means having a U-shaped core and a convergence coil mounted on each leg of said U-shaped core, each said U-shaped core being positioned with respect to said electron beams such that the legs of said U-shaped core are perpendicular to the direction of in-line alignment of said electron beams and wherein the direction of movement of said convergence coil means is perpendicular to the direction of in-line alignment of said electron beams;

(e) mounting means for mounting said convergence coil means on said coil separator means; and (f) means for moving said convergence coil means in a direction perpendicular to the direction of in-line alignment of said electron beams for adjusting the convergence of said electron beams.

2. A deflection yoke apparatus in accordance with claim 1, wherein said convergence coil means are arranged above and below the neck of said cathode-ray tube in a direction perpendicular to the in-line direction of said three electron beams.

3. A deflection yoke apparatus in accordance with claim 1, wherein said coil separator means includes an expanded chamber which houses the terminals of said horizontal deflection coil and a support means for supporting said convergence coil means on said coil separator, said support means comprising a cover engaging said expanded chamber.

4. A deflection yoke apparatus for color television cathode-ray tubes having three in-line electron beams, said apparatus comprising:

(a) a flared deflection core;

(b) a horizontal deflection coil mounted on the inside of said core, said horizontal deflection coil generating a pin-cushion type deflection field for deflecting said three electron beams in the horizontal direction;

(c) a vertical deflection coil positioned around said horizontal deflection coil, said vertical deflection coil generating a barrel type deflection field for deflecting said three electron beams in a vertical direction;

(d) a coil separator positioned between said deflection coils for electrically insulating said coils;

(e) a pair of movable convergence coil means for converging said three electron beams onto the screen of said cathode-ray tube, each said convergence coil means having a U-shaped core and a pair of convergence coils mounted on the legs of said U-shaped core, wherein the legs of each of said U-shaped cores are positioned perpendicular to the direction of in-line alignment of said electron beams and wherein the direction of movement of said convergence coil means is perpendicular to the direction of in-line alignment of said electron beams;

(f) support means for supporting said convergence coil means behind said horizontal deflection coil;

(g) moving means for moving said convergence coil means in a direction perpendicular to the direction of in-line alignment of said electron beams for adjusting the convergence of said electron beams; and (h) means for supplying a vertical deflection current to said convergence coil means.

5. A deflection yoke apparatus in accordance with claim 4, wherein said support means comprises a cover engaged with said separator, said cover covering the rear part of the coil separator and positioning said pair of convergence coil means substantially at positions behind the terminals of said horizontal deflection coil.

* * * * *